US009342968B2

(12) United States Patent
Allen et al.

(10) Patent No.: US 9,342,968 B2
(45) Date of Patent: May 17, 2016

(54) ELECTRONIC ARTICLE SURVEILLANCE SYSTEMS IMPLEMENTING METHODS FOR DETERMINING SECURITY TAG LOCATIONS

(71) Applicants: John A. Allen, Pompano Beach, FL (US); Manuel Soto, Lake Worth, FL (US)

(72) Inventors: John A. Allen, Pompano Beach, FL (US); Manuel Soto, Lake Worth, FL (US)

(73) Assignee: Tyco Fire & Security GmbH, Neuhausen AM, Rheinfall (CH)

( * ) Notice: Subject to any disclaimer, the term of this patent is extended or adjusted under 35 U.S.C. 154(b) by 140 days.

(21) Appl. No.: 14/457,655

(22) Filed: Aug. 12, 2014

(65) Prior Publication Data

US 2016/0049058 A1 Feb. 18, 2016

(51) Int. Cl.
*G08B 13/24* (2006.01)
*G08B 29/18* (2006.01)

(52) U.S. Cl.
CPC ..... *G08B 13/2462* (2013.01); *G08B 13/2417* (2013.01); *G08B 13/2468* (2013.01); *G08B 13/2471* (2013.01); *G08B 13/2482* (2013.01); *G08B 29/185* (2013.01); *G08B 13/2402* (2013.01); *G08B 13/2408* (2013.01); *G08B 13/2448* (2013.01)

(58) Field of Classification Search
CPC ..... G08B 13/2448
USPC ..... 340/10.3
See application file for complete search history.

(56) References Cited

U.S. PATENT DOCUMENTS

| | | | | |
|---|---|---|---|---|
| 4,249,167 | A * | 2/1981 | Purinton | G08B 13/2408 340/551 |
| 4,510,489 | A | 4/1985 | Anderson, III et al. | |
| 4,510,490 | A | 4/1985 | Anderson, III et al. | |
| 5,285,194 | A | 2/1994 | Ferguson | |
| 6,307,473 | B1 * | 10/2001 | Zampini | G08B 13/1645 340/10.1 |
| 2010/0207765 | A1 * | 8/2010 | Brander | G06K 7/0008 340/572.1 |
| 2012/0119883 | A1 * | 5/2012 | Bekritsky | G06K 7/10356 340/10.4 |

FOREIGN PATENT DOCUMENTS

| | | |
|---|---|---|
| WO | 2008/013780 A1 | 11/2008 |
| WO | 2014/062238 A1 | 4/2014 |

* cited by examiner

*Primary Examiner* — Travis Hunnings
*Assistant Examiner* — Benyam Haile
(74) *Attorney, Agent, or Firm* — Fox Rothschild, LLP; Robert J. Sacco; Carol E. Thorstad-Forsyth

(57) ABSTRACT

Systems (100) and methods (600) for detecting a location of an EAS security tag (112). The methods involve: determining a first amplitude of a response signal generated by the EAS security tag and received at a first pedestal (102*a*), and a second amplitude of the response signal received at a second pedestal (102*b*); processing the first and second amplitudes to determine whether the EAS security tag resides within a specified distance range of the first or second pedestal, a detection zone of an EAS detection system, or a backfield of the EAS detection system; issuing an alarm when the EAS security tag is determined to reside within the specified distance range of the first/second pedestal or the detection zone of the EAS detection system; and preventing issuance of the alarm when the EAS security tag is determined to reside in the backfield of the EAS detection system.

12 Claims, 6 Drawing Sheets

FIG. 7

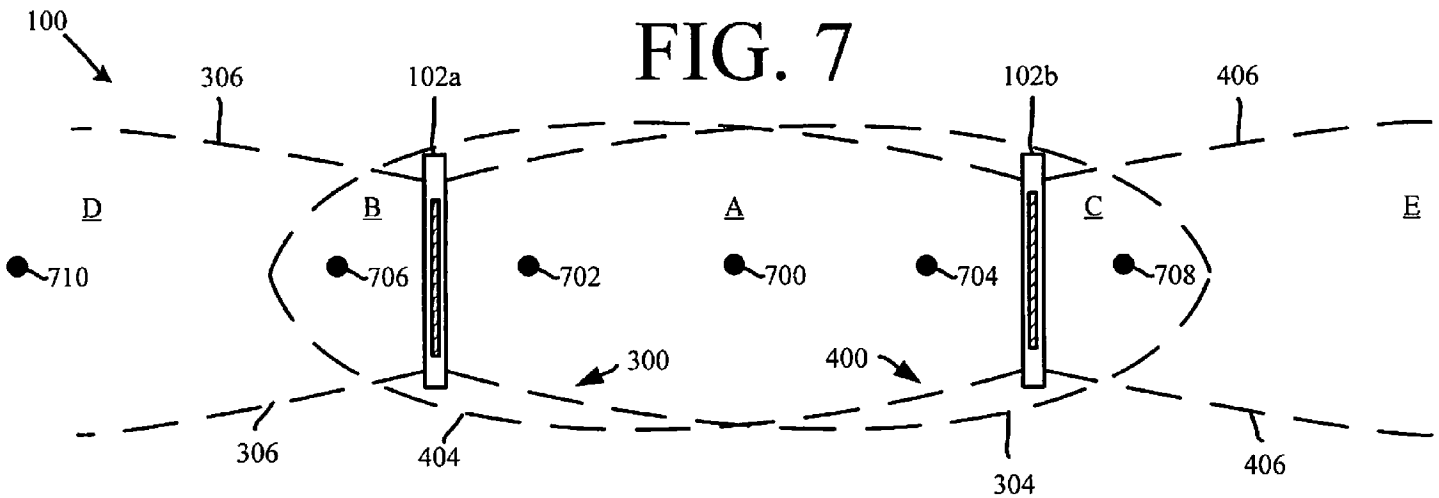

| | |
|---|---|
| 700 | First Ratio = $AMP_{102a}/AMP_{102b} = 1$, because antennas 302, 402 of both pedestals 102a, 102b see the same amount of energy associated with a response single transmitted from an EAS security tag located at position 700 |
| 702 | First Ratio = $AMP_{102a}/AMP_{102b} > 1$, because the antenna 302 of pedestal 102a sees a greater amount of energy associated with a response single transmitted from an EAS security tag located at position 702 then the antenna 402 of pedestal 102b |
| 704 | First Ratio = $AMP_{102b}/AMP_{102a} > 1$, because the antenna 402 of pedestal 102b sees a greater amount of energy associated with a response single transmitted from an EAS security tag located at position 704 then the antenna 302 of pedestal 102a |
| 706 | First Ratio = $AMP_{102a}/AMP_{102b}$ > second threshold, because (1) the amplitude $AMP_{102a}$ has the same value when the EAS security tag resides at locations 702 and 706, and (2) the amplitude $AMP_{102b}$ has a smaller value when the EAS security tag resides at location 706 as compared to location 702 |
| 708 | First Ratio = $AMP_{102b}/AMP_{102a}$ > second threshold, because (1) the amplitude $AMP_{102b}$ has the same value when the EAS security tag resides at locations 704 and 708, and (2) the amplitude $AMP_{102a}$ has a smaller value when the EAS security tag resides at location 708 as compared to location 704 |
| 710 | First Ratio = $AMP_{102a}/AMP_{Noise}$ < second threshold, but Second Ratio = $AMP_{102b} / AMP_{MeanNoise\text{-}102b}$ < third threshold so alarm is not issued |

ELECTRONIC ARTICLE SURVEILLANCE SYSTEMS IMPLEMENTING METHODS FOR DETERMINING SECURITY TAG LOCATIONS

BACKGROUND OF THE INVENTION

1. Statement of the Technical Field

The present invention relates generally to Electronic Article Surveillance ("EAS") systems. More particularly, the present invention relates to EAS systems implementing methods for determining security tag locations relative to transceiver pedestals thereof.

2. Description of the Related Art

Electronic article surveillance (EAS) systems generally comprise an interrogation antenna for transmitting an electromagnetic signal into an interrogation zone, markers which respond in some known electromagnetic manner to the interrogation signal, an antenna for detecting the response of the marker, a signal analyzer for evaluating the signals produced by the detection antenna, and an alarm which indicates the presence of a marker in the interrogation zone. The alarm can then be the basis for initiating one or more appropriate responses depending upon the nature of the facility. Typically, the interrogation zone is in the vicinity of an exit from a facility such as a retail store, and the markers can be attached to articles such as items of merchandise or inventory.

One type of EAS system utilizes acoustomagnetic (AM) markers. The general operation of an AM EAS system is described in U.S. Pat. Nos. 4,510,489 and 4,510,490, the disclosure of which is herein incorporated by reference. The detection of markers in an AM EAS system by pedestals placed at an exit has always been specifically focused on detecting markers only within the spacing of the pedestals. However, the interrogation field generated by the pedestals may extend beyond the intended detection zone. For example, a first pedestal will generally include a main antenna field directed toward a detection zone located between the first pedestal and a second pedestal. When an exciter signal is applied at the first pedestal it will generate an electro-magnetic field of sufficient intensity so as to excite markers within the detection zone. Similarly, the second pedestal will generally include an antenna having a main antenna field directed toward the detection zone (and toward the first pedestal). An exciter signal applied at the second pedestal will also generate an electromagnetic field with sufficient intensity so as to excite markers within the detection zone. When a marker tag is excited in the detection zone, it will generate an electromagnetic signal which can usually be detected by receiving the signal at the antennas associated with the first and second pedestal.

It is generally desirable to direct all of the electromagnetic energy from each pedestal exclusively toward the detection zone between the two pedestals. As a practical matter, however, a certain portion of the electromagnetic energy will be radiated in other directions. For example, an antenna contained in an EAS pedestal will frequently include a backfield antenna lobe ("backfield") which extends in a direction which is generally opposed from the direction of the main field. It is known that markers present in the backfield of antennas associated with the first or second pedestal may emit responsive signals, and create undesired alarms.

Several techniques have been implemented in the past to eliminate alarms causes by the backfield. One approach involves configuring the antenna in each pedestal in a manner which minimizes the actual extent of the backfield. Other solutions can involve changing from the traditional dual-transceiver pedestal to a TX pedestal/RX pedestal system, alternating TX/RX modes, and physical shielding of the antenna pedestals. A further approach involves correlating video analytics with marker signals. An ideal solution to the backfield problem is one which does not alter the detection performance of a system in a negative manner. For instance, although a system in which only one pedestal transmits and the other pedestal receives can reduce undesired alarms, pedestal separation in such a system must be reduced to accomplish the desired backfield reduction.

SUMMARY OF THE INVENTION

The present invention concerns implementing systems and methods for detecting a location of an EAS relative to an EAS detection system. The methods involve determining a first amplitude of a response signal generated by the EAS security tag and received at a first pedestal, and a second amplitude of the response signal received at a second pedestal spaced apart from the first pedestal. The first and second amplitudes are then processed to determine whether the EAS security tag resides within a specified distance range of the first or second pedestal, a detection zone of an EAS detection system, or a backfield of the EAS detection system. An alarm is issued when the EAS security tag is determined to reside within the specified distance range of the first or second pedestal or the detection zone of the EAS detection system. Issuance of the alarm is prevented when the EAS security tag is determined to reside in the backfield of the EAS detection system.

In some scenarios, the processing comprises: identifying which of the first and second amplitudes has the highest relative value; and determining whether the highest relative value exceeds a first threshold value. The alarm is issued when the highest relative value exceeds the first threshold value. The first threshold value is selected to facilitate an identification of an EAS security tag located within the specified distance range of a pedestal.

The processing may also comprise: computing a first ratio between the first and second amplitudes; and determining whether the first ratio exceeds a second threshold value. Issuance of the alarm is prevented when the first ratio is greater than a second threshold value. The second threshold value is selected to facilitate an identification of an EAS security tag located within the backfield of the EAS detection system.

The processing may further comprise: computing a second ratio between the first or second amplitude with the lowest value and an antenna mean noise amplitude for a corresponding one of the first and second pedestals; and determining if the second ratio is less than a third threshold value. The alarm is issued when the first ratio is less than the second threshold value and the second ratio is greater than a third threshold value. The third threshold value is selected to facilitate a detection of a false alarm condition.

BRIEF DESCRIPTION OF THE DRAWINGS

Embodiments will be described with reference to the following drawing figures, in which like numerals represent like items throughout the figures, and in which:

FIG. 7 is schematic illustration that is useful for understanding various computations performed by the EAS controller of FIG. 1.

DETAILED DESCRIPTION OF THE INVENTION

Figure 1:
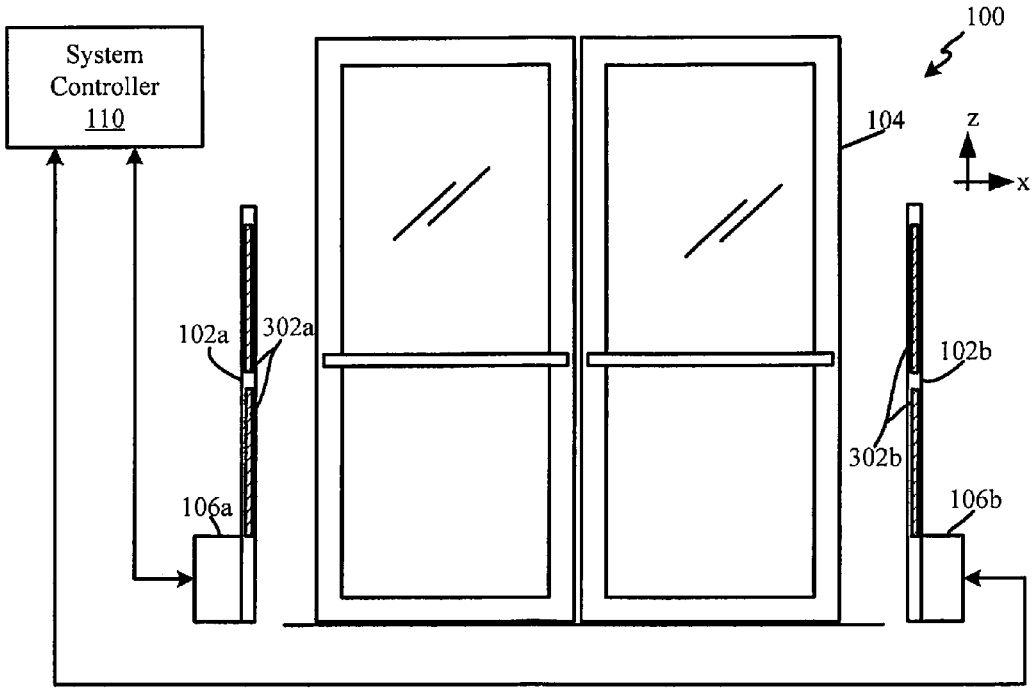
FIG. 1 is a side view of an EAS detection system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present invention generally provides a technique for identifying the approximate location of an EAS security tag with sufficient granularity to determine if the EAS security tag is located between a pair of EAS pedestals or behind one of the EAS pedestals in the "backfield." The idea is to use detected amplitudes of signals respectively received at the pedestals and calculate a ratio of these detected amplitudes. The ratio indicates whether the EAS security tag is located between the pair of EAS pedestals or behind one of the EAS pedestals. For example, if the EAS security tag is at the center of an interrogation zone (i.e., the detection zone between the EAS pedestals), then the ratio will equal one. In contrast, if the EAS security tag moves towards one of the EAS pedestals, then the ratio will equal a value greater than one. A ratio range is then used to identify the interrogation zone between the EAS pedestals. In effect, the present invention provides a way to reduce undesired alarms of an EAS detection system having at least two transceiver pedestals between which an interrogation zone (or detection zone) is defined.

Notably, the solution of the present invention can be entirely implemented in software. As such, the present invention does not add new hardware or additional cost to existing EAS detection systems. Additionally, the present invention can also be readily ported to older EAS detection systems to enhance their performance accordingly. Furthermore, the present invention does not alter the detection performance of an EAS detection system in a negative manner.

Figure 2:
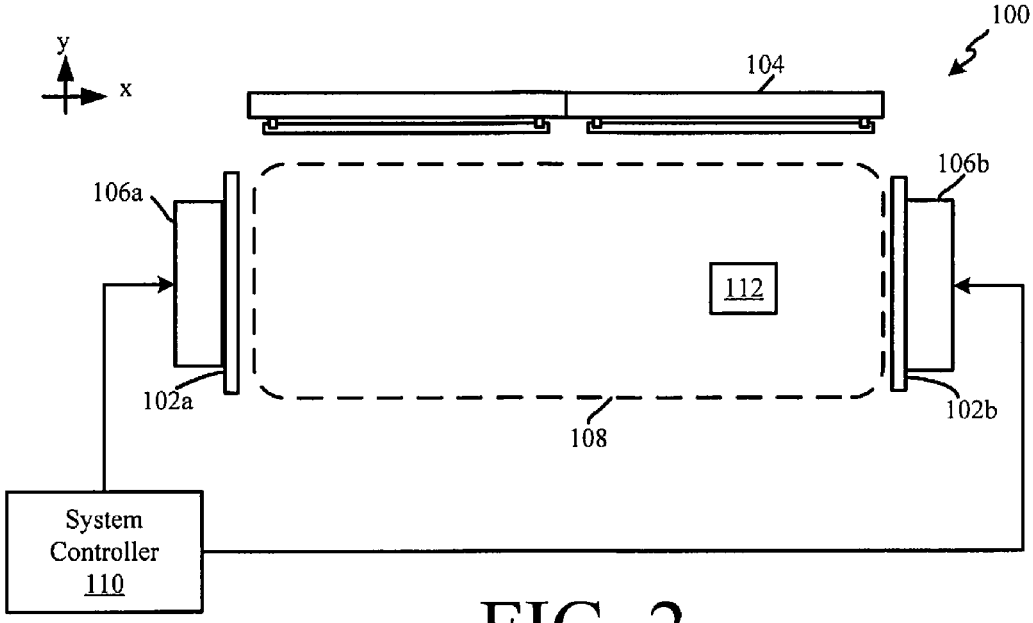
FIG. 2 is a top view of the EAS detection system in FIG. 1, which is useful for understanding an EAS detection zone thereof.

Referring now to FIGS. 1 and 2, an exemplary architecture for an EAS detection system 100 is provided. Notably, the present invention is described herein in terms of an AM EAS system. However, the method of the invention can also be used in other types of EAS systems, including systems that use Radio Frequency ("RF") type tags and Radio Frequency IDentification ("RFID") EAS systems.

The EAS detection system 100 will be positioned at a location adjacent to an entry/exit 104 of a secured facility (e.g., a retail store). The EAS detection system 100 uses specially designed EAS marker tags ("security tags") which are applied to store merchandise or other items which are stored within a secured facility. The security tags can be deactivated or removed by authorized personnel at the secure facility. For example, in a retail environment, the security tags could be removed by store employees. When an active security tag 112 is detected by the EAS detection system 100 in an idealized representation of an EAS detection zone 108 near the entry/exit, the EAS detection system will detect the presence of such security tag and will sound an alarm or generate some other suitable EAS response. Accordingly, the EAS detection system 100 is arranged for detecting and preventing the unauthorized removal of articles or products from controlled areas.

The EAS detection system 100 includes a pair of pedestals 102*a*, 102*b*, which are located a known distance apart (e.g., at opposing sides of entry/exit 104). The pedestals 102*a*, 102*b* are typically stabilized and supported by a base 106*a*, 106*b*. The pedestals 102*a*, 102*b* will each generally include one or more antennas that are suitable for aiding in the detection of the special EAS security tags, as described herein. For example, pedestal 102*a* can include at least one antenna 302 suitable for transmitting or producing an electromagnetic exciter signal field and receiving response signals generated by security tags in the detection zone 108. In some embodiments, the same antenna can be used for both receive and transmit functions. Similarly, pedestal 102*b* can include at least one antenna 402 suitable for transmitting or producing an electromagnetic exciter signal field and receiving response signals generated by security tags in the detection zone 108.

The antennas provided in pedestals 102*a*, 102*b* can be conventional conductive wire coil or loop designs as are commonly used in AM type EAS pedestals. These antennas will sometimes be referred to herein as exciter coils. In some embodiments, a single antenna can be used in each pedestal. The single antenna is selectively coupled to the EAS receiver. The EAS transmitter is operated in a time multiplexed manner. However, it can be advantageous to include two antennas (or exciter coils) in each pedestal as shown in FIG. 1, with an upper antenna positioned above a lower antenna.

The antennas located in the pedestals 102*a*, 102*b* are electrically coupled to a system controller 110. The system controller 110 controls the operation of the EAS detection system 100 to perform EAS functions as described herein. The system controller 110 can be located within a base 106*a*, 106*b* of one of the pedestals 102*a*, 102*b* or can be located within a separate chassis at a location nearby to the pedestals. For example, the system controller 110 can be located in a ceiling just above or adjacent to the pedestals 102*a*, 102*b*.

As noted above, the EAS detection systems comprises an AM type EAS detection system. As such, each antenna is used to generate an Electro-Magnetic ("EM") field which serves as a security tag exciter signal. The security tag exciter signal causes a mechanical oscillation of a strip (e.g., a strip formed of a magnetostrictive or ferromagnetic amorphous metal) contained in a security tag within a detection zone 108. As a result of the stimulus signal, the security tag will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the detection zone 108. As noted above, the same antenna contained in a pedestal 102*a*, 102*b* can serve as both the transmit antenna and the receive antenna. Accordingly, the antennas in each of pedestals 102*a*, 102*b* can be used in several different modes to detect a security tag exciter signal. These modes will be described below in further detail.

Figure 3:
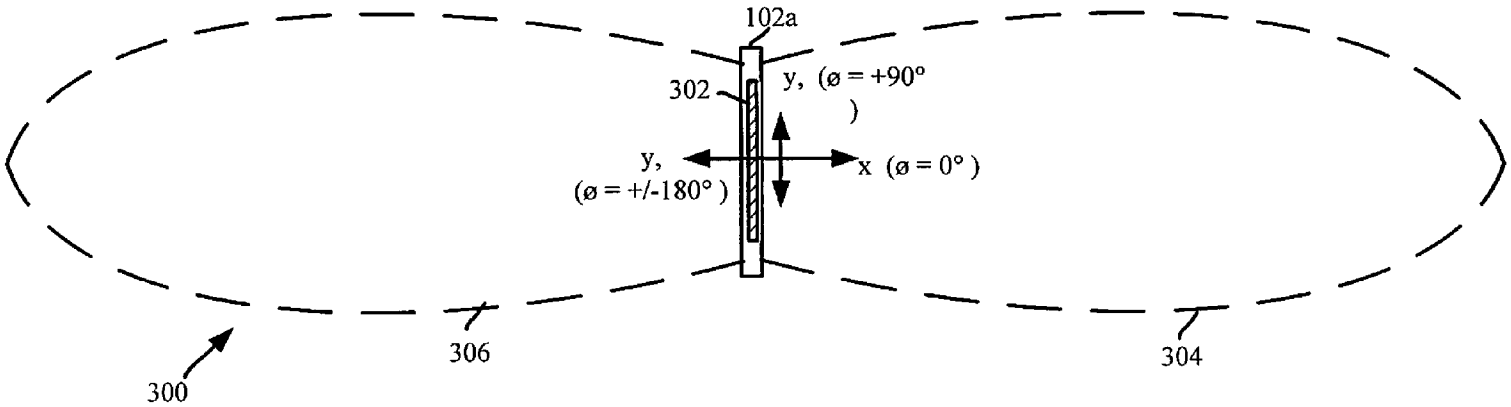
FIGS. 3 and 4 are drawings which are useful for understanding a main field and a backfield of antennas which are used in the EAS detection system of FIG. 1.
Figure 4:
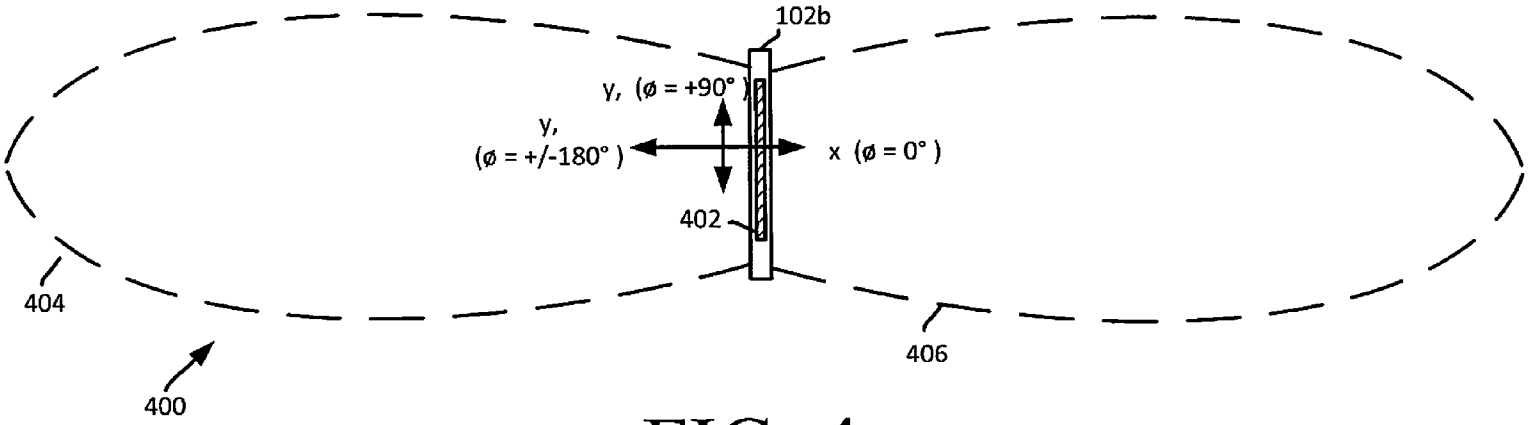

Referring now to FIGS. 3 and 4, there are shown exemplary antenna field patterns 300, 400 for antennas 302, 402 contained in pedestals 102*a*, 102*b*. As is known in the art, an antenna radiation pattern is a graphical representation of the radiating (or receiving) properties for a given antenna as a function of space. The properties of an antenna are the same in a transmit and receive mode of operation. As such, the antenna radiation pattern shown is applicable for both transmit and receive operations as described herein. The exemplary antenna field patterns 300, 400 shown in FIGS. 3-4 are azimuth plane pattern representing the antenna pattern in the x, y coordinate plane. The azimuth pattern is represented in polar coordinate form and is sufficient for understanding the inventive arrangements. The azimuth antenna field patterns shown in FIGS. 3-4 are a useful way of visualizing the direction in which the antennas 302, 402 will transmit and receive signals at a particular power level.

Figure 5:
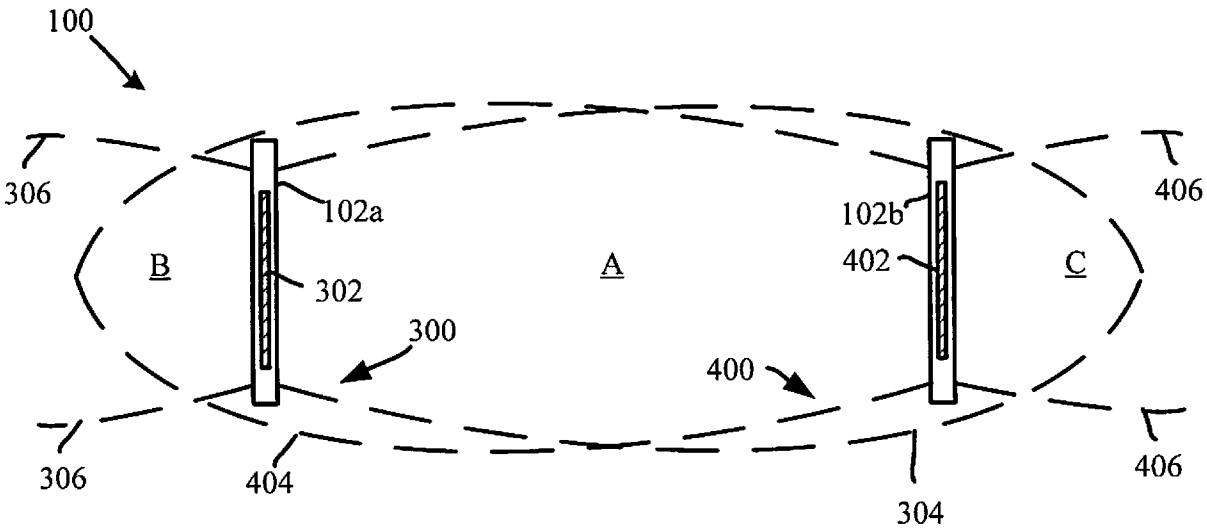
FIG. 5 is a drawing which is useful for understanding a detection zone in the EAS detection system of FIG. 1.

The antenna field pattern 300 shown in FIG. 3 includes a main lobe 304 with a peak at ø=0° and a backfield lobe 306 with a peak at angle ø=180°. Conversely, the antenna field pattern 400 shown in FIG. 4 includes a main lobe 404 with its peak at ø=180° and a backfield lobe 406 with a peak at angle ø=0°. In the EAS detection system 100, each pedestal 102*a*, 102*b* is positioned so that the main lobe of an antenna contained therein is directed into the detection zone 108. Accordingly, a pair of pedestals 102*a*, 102*b* in the EAS detection system 100 will produce overlap in the antenna field patterns 300, 400, as shown in FIG. 5. Notably, the antenna field patterns 300, 400 shown in FIG. 5 are scaled for purposes of understanding the present invention. In particular, the patterns show the outer boundary or limits of an area in which an exciter signal of particular amplitude applied to antennas 302, 402 will produce a detectable response in an EAS security tag. However, it should be understood that a security tag within the bounds of at least one antenna field pattern 300, 400 will generate a detectable response when stimulated by an exciter signal.

The overlapping antenna field patterns 300, 400 in FIG. 5 will include an area A where there is overlap of main lobes 304, 404. However, it can be observed in FIG. 5 that there can also be some overlap of a main lobe of each pedestal with a backfield lobe associated with the other pedestal. For example, it can be observed that the main lobe 404 overlaps with the backfield lobe 306 within an area B. Similarly, the main lobe 304 overlaps with the backfield lobe 306 in an area C. Area A between pedestals 102*a*, 102*b* defines the detection zone 108 in which active security tags should cause the EAS detection system 100 to generate an alarm response. Security tags in area A are stimulated by energy associated with an exciter signal within the main lobes 304, 404 and will produce a response which can be detected at each antenna. The response produced by a security tag in area A is detected within the main lobes of each antenna and processed in the system controller 110. Notably, a security tag in areas B or C will also be excited by the antennas 302, 402. The response signal produced by a security tag in these areas B and C will also be received at one or both antennas. This condition is not desirable because it can produce EAS alarms at system controller 110 when there is in fact no security tag present within the detection zone 108 between the pedestals 102*a*, 102*b*. Accordingly, a method will now be described which is useful for determining when a detected security tag is within the detection zone (area A) or within the backfield zone (area B or area C). The process described herein is advantageous as it can be implemented in the EAS detection system 100 by simply updating the software in system controller 110 without modifying any of the other hardware elements associated with the system.

Figure 6:
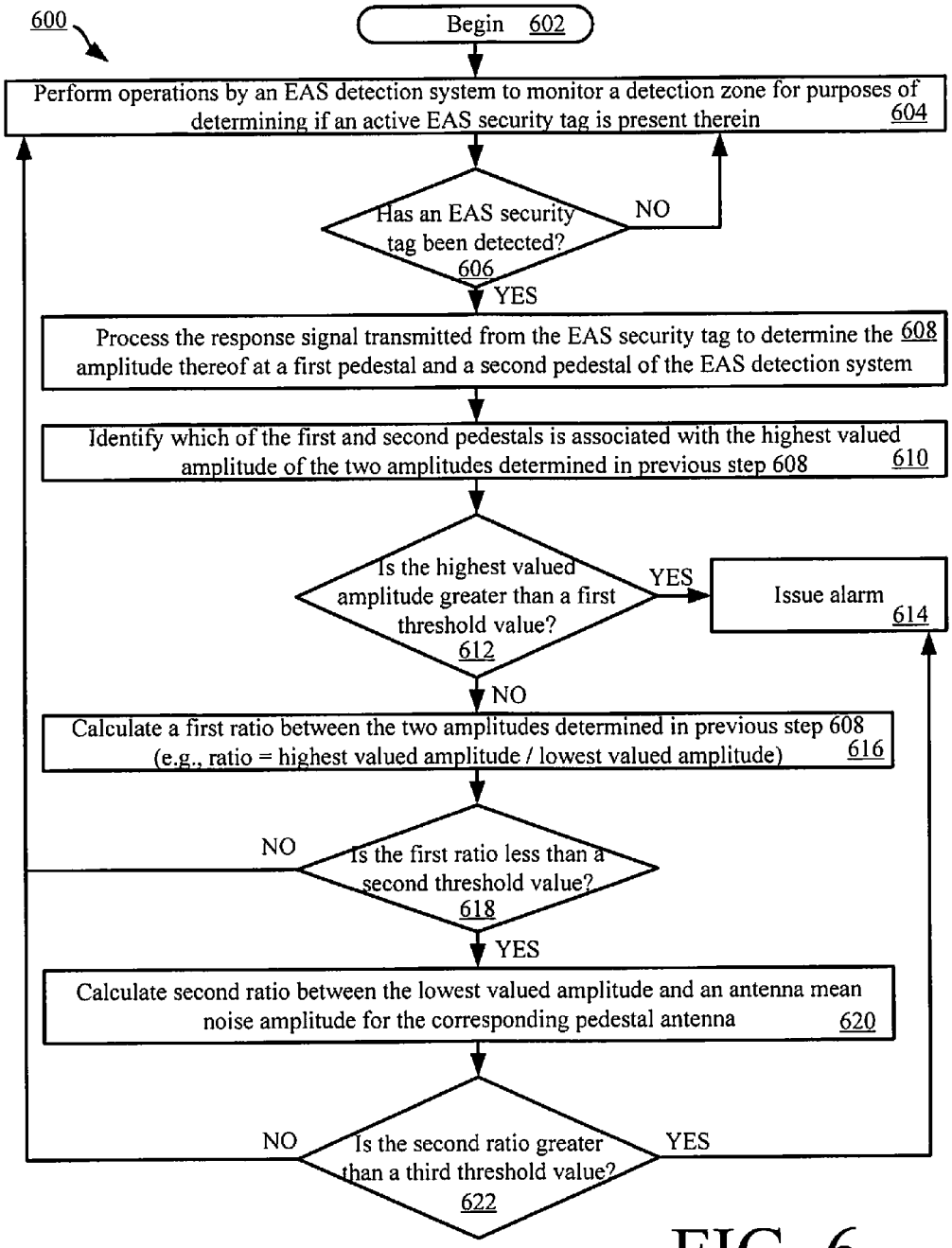
FIG. 6 is a flowchart of an exemplary method for determining the location of a security tag relative to the pedestals of the EAS detection system of FIG. 1.

Referring now to FIG. 6, there is provided a flowchart of an exemplary method 600 for selectively issuing an alarm based on a detected location of an EAS security tag. Method 600 generally describes an inventive algorithm that compares the amplitude of a security tag response captured in antennas 302, 402, and then uses that information to prevent undesired alarms caused by EAS security tags present in the backfield lobe 306, 406 of an antenna. Method 600 can be at least partially implemented by system controller 110.

As shown in FIG. 6, method 600 begins at 602 and continues to 604 where the detection zone (e.g., area A) is monitored to determine if an active EAS security tag is present. An active EAS security tag is detected when a response signal transmitted therefrom is received by the pedestals 102*a*, 102*b* of the EAS detection system 100. If an active EAS security tag is not detected by the pedestals [606:NO], then method 600 continues monitoring the detection zone. In contrast, if an active EAS security tag is detected by the pedestals [606:YES], then method 600 continues with step 608 where the response signal received at pedestal 102*a* is further processed to determine an amplitude $AMP_{102a}$ thereof. Similarly, the response signal received at pedestal 102*b* is further processed to determine an amplitude $AMP_{102b}$ thereof.

Next in step 610, the amplitudes $AMP_{102a}$ and $AMP_{102b}$ are analyzed to identify which of the pedestals 102*a* or 102*b* is associated with the highest valued amplitude. In this regard, each amplitude can be previously stored in a table format so as to be associated with the corresponding pedestal. In this case, step 610 involves: comparing the amplitudes $AMP_{102a}$ and $AMP_{102b}$ to each other to determine which one has the highest value; and accessing a table to obtain information specifying which pedestal is associated with the highest valued amplitude. For example, if amplitude $AMP_{102a}$ has the highest value, then pedestal 102*a* would be identified in step 610. In contrast, if amplitude $AMP_{102b}$ has the highest value, then pedestal 102*b* would be identified in step 610.

Upon identifying a pedestal in step 610, a decision step 612 is performed where it is determined if the highest valued amplitude (e.g., amplitude $AMP_{102a}$) is greater than a first threshold value $thr_1$. The first threshold value $thr_1$ is selected such that it is less than an amplitude $AMP_{102a}$ or $AMP_{102b}$ of a response signal transmitted from an EAS security tag located at a position less than N feet from the corresponding pedestal, where N is any number falling in a given range (e.g., 0 feet to 1.5 feet). If the highest valued amplitude (e.g., amplitude $AMP_{102a}$) is greater than a first threshold value $thr_1$ [612:YES], then an alarm is issued in step 614.). If the highest valued amplitude (e.g., amplitude $AMP_{102a}$) is less than a first threshold value $thr_1$ [612:YES], then method 600 continues with step 616.

In step 616, a first ratio is computed between the two amplitudes $AMP_{102a}$ and $AMP_{102b}$. A mathematical equation (1) defining the first ratio is now provided.

$$R_1 = AMP_{HighestValue}/AMP_{LowestValue} \quad (1)$$

where $R_1$ represents the first ratio, $AMP_{HighestValue}$ represents an amplitude with the highest value (e.g., $AMP_{102a}$), and $AMP_{LowestValue}$ represents an amplitude with the lowest value (e.g., $AMP_{102b}$).

If the two amplitudes $AMP_{102a}$ and $AMP_{102b}$ have the same value, then the first ratio $R_1$ equals one. As shown in FIG. 7, when the EAS security tag 112 resides at location 700, it is the same distance from the antennas 302, 402 of the pedestals 102*a*, 102*b*. In this case, the antennas 302, 402 see the same amount of energy associated with the response signal transmitted from the EAS security tag 112.

If amplitude $AMP_{102a}$ has a higher value than amplitude $AMP_{102b}$, the first ratio $R_1$ is defined by mathematical equation (2).

$$R_1 = AMP_{102a}/AMP_{102b} \quad (2)$$

Accordingly, the first ratio $R_1$ has a value greater than one. As shown in FIG. 7, when the EAS security tag 112 resides at location 702, it is closer to antenna 302 of pedestal 102*a* than antenna 402 of pedestal 102*b*. In this case, antenna 302 of pedestal 102*a* sees a greater amount of energy associated with a response signal transmitted from the EAS security tag 112 located at position 702 than that seen by antenna 402 of pedestal 102*b*.

If the amplitude $AMP_{102b}$ has a higher value than amplitude $AMP_{102a}$, the first ratio $R_1$ is defined by mathematical equation (3).

$$R_1 = AMP_{102b}/AMP_{102a} \quad (3)$$

Accordingly, the first ratio $R_1$ has a value greater than one. As shown in FIG. 7, when the EAS security tag 112 resides at location 704, it is closer to antenna 402 of pedestal 102*b* than antenna 302 of pedestal 102*a*. In this case, antenna 402 of pedestal 102*b* sees a greater amount of energy associated with a response signal transmitted from the EAS security tag 112 located at position 704 than that seen by antenna 302 of pedestal 102*a*.

Referring again to FIG. 6, method 600 continues with a decision step 618. In step 618, it is determined if the first ratio $R_1$ is less than a second threshold value $thr_2$. When the first ratio $R_1$ is less than a second threshold value $thr_2$, the EAS security tag 112 is deemed to be in the detection zone 108. When the first ratio $R_1$ is greater than a second threshold value $thr_2$, the EAS security tag 112 is deemed to be in the backfield. This concept can be readily understood with reference to FIG. 7. As shown in FIG. 7, when the EAS security tag 112 is positioned at location 706, the amplitude $AMP_{102a}$ has the same value as it would when the EAS security tag 112 is positioned at location 702. However, the amplitude $AMP_{102b}$ is less than it would be when the EAS security tag 112 is positioned at location 702. In effect, the value of the first ratio $R_1$ is greater when the EAS security tag 112 is positioned at location 706 as compared to when the EAS security tag 112 is positioned at location 702. This is also true when the EAS security tag 112 is positioned at location 708 as compared to when the EAS security tag 112 is positioned at location 704.

As shown in FIG. 6, the alarm is not issued when the first ratio $R_1$ has a value indicating that the EAS security tag 112 resides in the backfield. In this regard, the method 600 returns to step 604 in which the detection zone is monitored when a determination is made in step 618 that the first ratio is greater than the second threshold value $thr_2$. When the first ratio $R_1$ has a value indicating that the EAS security tag 112 resides in the detection zone 108, the method 600 continues with steps 620-622 to determine if the alarm should be issued.

Step 620 is generally performed to ensure that certain conditions do not cause issuance of a false alarm. An exemplary false alarm condition is readily understood with reference to FIG. 7. As shown in FIG. 7, an EAS security tag 112 may reside at a plurality of different locations 702-710 within a given environment. This environment has a certain amount of noise. As such, each pedestal antenna 302, 402 also receives a noise signal with an amplitude $AMP_{Noise}$. Let's first consider the scenario in which the EAS security tag 112 resides at location 702. If the amplitude $AMP_{102a}$ has a value of one hundred and the amplitude $AMP_{Noise}$ has a value of fifty, then the first ratio $R_1$ has a value of two. Now, let's consider the scenario in which the EAS security tag 112 resides at location 710. In this case, the antenna 302 of pedestal 102*a* detects the response signal with an amplitude $AMP_{102a}$. However, the antenna 402 of pedestal 102*b* does not detect the response signal, but instead the noise signal with amplitude $AMP_{Noise}$. If the amplitude $AMP_{102a}$ has a value of twenty and the amplitude $AMP_{Noise}$ has a value of ten, then the first ratio $R_1$ also has a value of two. Thus, the alarm may be falsely triggered when the EAS security tag 112 resides at location 710.

Accordingly, steps 620-622 implement one method for detecting such a false alarm condition. In this regard, step 620 involves computing a second ratio $R_2$ between the lowest valued amplitude and a mean noise amplitude $AMP_{MeanNoise}$ of the corresponding pedestal antenna 302 or 402. For example, if the amplitude of a signal (e.g., response signal and/or noise signal) received at pedestal 102*b* has a relatively low value, than the second ratio $R_2$ is computed using the mean noise amplitude for antenna 402. When the second ratio $R_2$ is greater than a third threshold value $thr_3$, the alarm is issued as shown by step [622:YES]. When the second ratio $R_2$ is less than a third threshold value $thr_3$, method 600 returns to step 604 such that the detection zone continues to be monitored.

Figure 8:
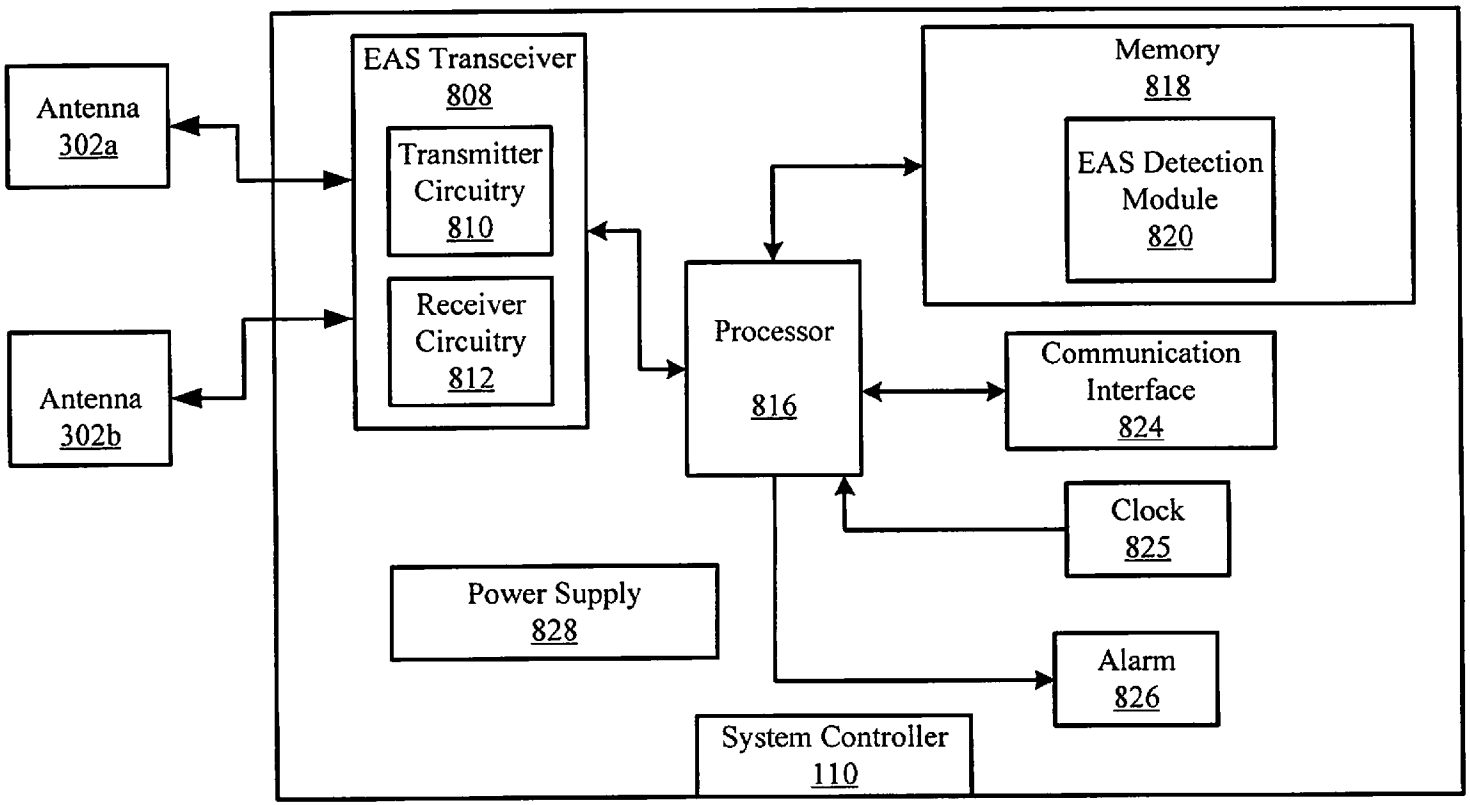
FIG. 8 is a block diagram that is useful for understanding an arrangement of an EAS controller which is used in the EAS detection system of FIG. 1.

Referring now to FIG. 8, there is provided a block diagram that is useful for understanding the arrangement of the system controller 110. The system controller comprises a processor 816 (such as a micro-controller or Central Processing Unit ("CPU")). The system controller also includes a computer readable storage medium, such as memory 818 on which is stored one or more sets of instructions (e.g., software code) configured to implement one or more of the methodologies, procedures or functions described herein. The instructions (i.e., computer software) can include an EAS detection module 820 to facilitate EAS detection and perform methods for selectively issuing an alarm based on a detected location of an EAS security tag, as described herein. These instructions can also reside, completely or at least partially, within the processor 816 during execution thereof.

The system also includes at least one EAS transceiver 808, including transmitter circuitry 810 and receiver circuitry 812. The transmitter and receiver circuitry are electrically coupled to antenna 302 and the antenna 402. A suitable multiplexing arrangement can be provided to facilitate both receive and transmit operation using a single antenna (e.g. antenna 302 or 402). Transmit operations can occur concurrently at antennas 302, 402 after which receive operations can occur concurrently at each antenna to listen for marker tags which have been excited. Alternatively, transmit operations can be selectively controlled as described herein so that only one antenna is active at a time for transmitting security tag exciter signals for purposes of executing the various algorithms described herein. The antennas 302, 402 can include an upper and lower antenna similar to those shown and described with respect to FIG. 1. Input exciter signals applied to the upper and lower antennas can be controlled by transmitter circuitry 810 or processor 816 so that the upper and lower antennas operate in a phase aiding or a phase opposed configuration as required.

Additional components of the system controller 110 can include a communication interface 824 configured to facilitate wired and/or wireless communications from the system controller 110 to a remotely located EAS system server. The system controller can also include a real-time clock, which is used for timing purposes, an alarm 826 (e.g. an audible alarm, a visual alarm, or both) which can be activated when an active EAS security tag is detected within the EAS detection zone 108. A power supply 828 provides necessary electrical power to the various components of the system controller 110. The electrical connections from the power supply to the various system components are omitted in FIG. 8 so as to avoid obscuring the invention.

Those skilled in the art will appreciate that the system controller architecture illustrated in FIG. 8 represents one possible example of a system architecture that can be used with the present invention. However, the invention is not limited in this regard and any other suitable architecture can be used in each case without limitation. Dedicated hardware implementations including, but not limited to, application-specific integrated circuits, programmable logic arrays, and other hardware devices can likewise be constructed to implement the methods described herein. It will be appreciated that the apparatus and systems of various inventive embodiments broadly include a variety of electronic and computer systems. Some embodiments may implement functions in two or more specific interconnected hardware modules or devices with related control and data signals communicated between and through the modules, or as portions of an application-specific integrated circuit. Thus, the exemplary system is applicable to software, firmware, and hardware implementations.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. A method for detecting a location of an Electronic Article Surveillance ("EAS") security tag, comprising:

determining a first amplitude of a response signal generated by the EAS security tag and received at a first pedestal, and a second amplitude of the response signal received at a second pedestal spaced apart from the first pedestal;

processing the first and second amplitudes to determine whether the EAS security tag resides within a specified distance range of the first or second pedestal, a detection zone of an EAS detection system, or a backfield of the EAS detection system;

issuing an alarm when the EAS security tag is determined to reside within the specified distance range of the first or second pedestal or the detection zone of the EAS detection system; and preventing issuance of the alarm when the EAS security tag is determined to reside in the backfield of the EAS detection system;

wherein the processing comprises identifying which of the first and second amplitudes has the highest relative value and the alarm is issued when the highest relative value exceeds a first threshold value.

2. The method according to claim 1, wherein the first threshold value is selected to facilitate an identification of an EAS security tag located within the specified distance range of a pedestal.

3. A method for detecting a location of an Electronic Article Surveillance ("EAS") security tag, comprising:

determining a first amplitude of a response signal generated by the EAS security tag and received at a first pedestal, and a second amplitude of the response signal received at a second pedestal spaced apart from the first pedestal;

processing the first and second amplitudes to determine whether the EAS security tag resides within a specified distance range of the first or second pedestal, a detection zone of an EAS detection system, or a backfield of the EAS detection system;

issuing an alarm when the EAS security tag is determined to reside within the specified distance range of the first or second pedestal or the detection zone of the EAS detection system;

wherein a first threshold value is selected to facilitate an identification of an EAS security tag located with the backfield of the EAS detection system; and wherein the processing comprises computing a first ratio between the first and second amplitudes and issuance of the alarm is prevented when the first ratio is greater than the first threshold value, indicating that the security tag is in the backfield of the EAS detection system.

4. The method according to claim 3, wherein the processing comprises computing a second ratio between the first or second amplitude with the lowest value and an antenna mean noise amplitude for a corresponding one of the first and second pedestals.

5. The method according to claim 4, wherein the alarm is issued when the first ratio is less than the first threshold value and the first ratio is greater than a second threshold value.

6. The method according to claim 5, wherein the second threshold value is selected to facilitate a detection of a false alarm condition.

7. An EAS detection system, comprising:

first and second pedestals forming a detection zone for an EAS security tag;

an electronic control circuit communicatively coupled to the first and second pedestals and having a software application running thereon which causes the following operations to be performed:

determining a first amplitude of a response signal generated by the EAS security tag and received at the first pedestal, and a second amplitude of the response signal received at the second pedestal, processing the first and second amplitudes to determine whether the EAS security tag resides within a specified distance range of the first or second pedestal, a detection zone of an EAS detection system, or a backfield of the EAS detection system, issuing an alarm when the EAS security tag is determined to reside within the specified distance range of the first or second pedestal or the detection zone of the EAS detection system, and preventing issuance of the alarm when the EAS security tag is determined to reside in the backfield of the EAS detection system;

wherein the processing comprises identifying which of the first and second amplitudes has the highest relative value and the alarm is issued when the highest relative value exceeds a first threshold value.

8. The EAS detection system according to claim 7, wherein the first threshold value is selected to facilitate an identification of an EAS security tag located within the specified distance range of a pedestal.

9. An EAS detection system, comprising:

first and second pedestals forming a detection zone for an EAS security tag;

an electronic control circuit communicatively coupled to the first and second pedestals and having a software application running thereon which causes the following operations to be performed;

determining a first amplitude of a response signal generated by the EAS security tag and received at the first pedestal, and a second amplitude of the response signal received at the second pedestal, processing the first and second amplitudes to determine whether the EAS security tag resides within a specified distance range of the first or second pedestal, a detection zone of an EAS detection system, or a backfield of the EAS detection system, issuing an alarm when the EAS security tag is determined to reside within the specified distance range of the first or second pedestal or the detection zone of the EAS detection system, and preventing issuance of the alarm when the EAS security tag is determined to reside in the backfield of the EAS detection system;

wherein the processing comprises computing a first ratio between the first and second amplitudes, and issuance of the alarm is prevented when the first ratio is greater than a first threshold value which is selected to facilitate an identification of an EAS security tag located with the backfield of the EAS detection system.

10. The EAS detection system according to claim 9, wherein the processing comprises computing a second ratio between the first or second amplitude with the lowest value and an antenna mean noise amplitude for a corresponding one of the first and second pedestals.

11. The EAS detection system according to claim 10, wherein the alarm is issued when the first ratio is less than the first threshold value and the second ratio is greater than a second threshold value.

12. The EAS detection system according to claim 11, wherein the second threshold value is selected to facilitate a detection of a false alarm condition.

* * * * *